US006036560A

United States Patent [19]

Pekar

[11] Patent Number: 6,036,560

[45] Date of Patent: Mar. 14, 2000

[54] VARIABLE FLEXIBLE STRINGER, BODYBOARD AND METHOD

[75] Inventor: Scott Pekar, San Clemente, Calif.

[73] Assignee: Earth & Ocean Sports, Inc., Hyannis, Mass.

[21] Appl. No.: 09/245,547

[22] Filed: Feb. 5, 1999

[51] Int. Cl.[7] ..... B63B 1/00

[52] U.S. Cl. ..... 441/65; 441/74

[58] Field of Search ..... 441/65, 74, 79; 114/357

[56] References Cited

U.S. PATENT DOCUMENTS 3,414,919 12/1968 Gust .
5,114,370 5/1992 Moran .
5,224,890 7/1993 Moran .
5,816,875 10/1998 Bixby ..... 441/74

FOREIGN PATENT DOCUMENTS

WO 83/00127 1/1983 WIPO ..... 441/74

*Primary Examiner*—Ed Swinehart
*Attorney, Agent, or Firm*—Richard P. Crowley

[57] ABSTRACT

A variable flexible bodyboard, which includes therein, at least one variable, flexible stringer rod. The stringer rod composed of a material to impart stiffness to the body of the bodyboard, such as a fiber-resin material, and a material to impart flexibility to the front nose area of the bodyboard, such as a polyethylene material.

24 Claims, 2 Drawing Sheets

VARIABLE FLEXIBLE STRINGER, BODYBOARD AND METHOD

BACKGROUND OF THE INVENTION

A bodyboard generally comprises an elongated, contoured, lightweight, closed cell, foam core material having an outer top skin and a smooth, slick bottom skin. The bodyboard is employed for gliding on water and riding ocean surf.

Typically, in use, the rider of a bodyboard grips the front edge and front sides of the bodyboard with one hand to control steer and maneuver the bodyboard, thus, the rigidity and flexibility of the bodyboard can affect the performance of the bodyboard.

Bodyboards of selected and variable stiffness have been disclosed in U.S. Pat. No. 5,114,370, issued May 19, 1992; and U.S. Pat. No. 5,224,890, issued Jul. 6, 1993. These patents provide for a bodyboard composed of a semirigid, foam core material with a sheet of fiber mesh to stiffen the bodyboard from the tail toward the front end, and the use of a plurality of arcuate channels in the top surface of the nose end to enhance the flexibility of the nose portion of the bodyboard for rider control.

Many present bodyboards use a stringer system to increase the bodyboard rigidity and performance. The stringer system employs an elongated rod or element which is inserted and secured longitudinally in the foam core material. A stringer system would generally include a fiberglass or graphite rod which is centrally inserted and adhesively secured in a hole in the foam core material prior to application of the top and bottom skin layers.

The disadvantage of the current stringer systems used is that in extreme conditions of use or with long wear and use, when the board is bent up harshly or frequently, the stringer rod can and does pop out of the either the top deck or the bottom of the bodyboard. Such pop out of the stringer ruins the bodyboard and can possibly injure the rider. This problem is caused because the stringer does not flex or bend as easily as the foam board core material, usually a lightweight, low density, closed cell, polyethylene foam material which surrounds the stringer rod.

It is therefore desirable to provide a new and improved bodyboard and method of manufacture and use, which overcomes some of the disadvantages of the prior art bodyboards.

SUMMARY OF THE INVENTION

The invention relates to a variable flexible bodyboard and method, and in particular, concerns a bodyboard with a variable flexible, typically, a two-part stringer element and to the stringer element itself.

The invention comprises a variable flexible bodyboard which comprises a lightweight, generally elongated, foam core material having a top skin layer and a bottom skin layer, with a front nose end and a rear tail end; and an elongated stringer element having a one end and an other end, and generally longitudinally arranged within the foam core material and extending substantially from the tail end toward the front end; the stringer element varying in flexibility along the length, from the one end to the other end, a substantial first length portion of the stringer end extending at the one end and from the tail end of the foam core material, toward the nose end and adapted to increase the stiffness of the foam core material; and a second length portion toward the nose end of the foam core material, having greater flexibility than the first portion, and adapted to increase flexibility of the nose end of the bodyboard by a rider.

The invention comprises a stringer element, for example, a solid cylindrical rod which has a selected length and is adapted to be inserted into a foam core material of a bodyboard or flotation device to impart selective stiffness to the main body riding portions of the bodyboard and selected flexibility to the front and nose portion of the bodyboard for rider control purposes. The length of the stiffness and flexibility portion of the element may be varied for bodyboard performance reasons. The stringer element has a greater length portion of one material to impart stiffness, and another material toward the front or tip to impart flexibility to the element.

It is recognized that stiffness and flexibility may be imparted along the length of the stringer element employing the same material, but of different density; construction; polymerization properties; or combinations thereof. The stringer rod may have the same dimensions or be tapered along its length with a small diameter at its tip end.

In one embodiment, the stringer element comprises a solid rod of up to 24 to 30 inches or about 50 to 80% in length of a resin-impregnated fiber material for stiffness and about 6 to 12 inches or 20 to 50% in length of a flexible polymeric material like polyethylene for flexibility.

The stringer elements of the invention may be inserted or placed in the foam core material of the bodyboard in numerous ways, to include: laminating the foam core material or sheets with the stringer elements molded in place; or for example, holes drilled or formed within the foam core material, usually from the tail end, and the stringer elements snugly inserted into the holes; and optionally, adhesively secured in position, the hole ends sealed, and then the top skin and bottom skin layer laminated over the hole closures.

The invention provides for at least one elongated stringer element, such as an elongated rod along a majority of its length, composed of a material to impart stiffness to the bodyboard, while the front or tip section of the stringer element is composed of a softer, more flexible material to permit flexing of the nose and front portion of the bodyboard by a rider.

The stringer element will permit greater flexibility toward and at its tip or front end and may be selected to have the same or similar flex properties or pattern as the surrounding foam core material. The variable, flexible stringer element reduces the popping out or tearing out of the stringer element in use and provides the added benefit of an increase in the bodyboard projection in use, out of a turn, through the progressive release of energy after flexing of the stringer tip.

Therefore, the bodyboard with the variable stringer system overcomes the prior art problem of tearing through the bodyboard and provides selected stiffness to the main riding portions of the bodyboard and selected flexibility to the front and nose portions.

In one embodiment, the bodyboard would comprise a low density, e.g., 4 to 10 psi, closed cell polyethylene, semirigid foam core material of typically, about 2 inches in thickness, a length of about 36 to 42 inches and about 22 to 24 inches. A variable, flexible, solid stringer rod is generally centrally inserted in the foam core material from the tail end toward and into the front nose region of the bodyboard.

The stringer rod comprises a stiff portion of fiberglass or graphite resin-impregnated material and a flexible portion of a front tip end of a polyethylene or other flexible compatible material extending from about 6 to 12 inches from the tip end of the stringer rod element. The stringer rod usually mimics substantially the length of the foam core material and may have a diameter of about ½ to 1 inch. The stiff portion of the stringer rod provides stiffness to the bodyboard, while the flexible portion provides and generally matches the flexibility of the front nose area of the bodyboard. Optionally, rounded plastic caps may be used at each end of the stringer rod to reduce sharp edges.

Usually, the stringer rod or rods are inserted into a hole drilled from the tail end of the foam core material prior to lamination or application of the top and bottom skin layers and adhesively secured in the hole.

The stringer elements may be composed of a wide variety of materials provided that there is variable flexibility through the length of the element at or toward the front or tip end. The element material which makes up a major portion of the stringer length is selected to impart the required stiffness to the foam core material and may comprise a polymer, wound or woven fibers, resin-impregnated fibers, wood or other material; but prior art materials now used, such as thermoset resin-impregnated glass fiber and graphite fiber rods may be employed. The flexible portion or area of the stringer element may be selected and designed to be of greater flexibility than the stiffener material, and in a preferred embodiment, the flexible material should be selected to have the same or similar flex properties as the foam core material used. Thus, generally the flexible material would comprise a polymeric material, such as an olefin polymer, like an olefin, such as polyethylene to match the polyethylene foam material of the core; however, other materials and components may be used to provide the selected flex pattern required in the use of the bodyboard.

While the stringer rod contains two sections, a stiff section and a front flexible section, it is recognized and part of the invention that stringer elements, with a plurality of different materials along the length of the stringer element, may be employed to impart multiple lengthwise regions of selected, e.g., progressive increased flexibility. Such stringer elements may, for example, have three aligned connected regions composed of a stiff region for the body of the bodyboard, a region of greater flexibility, and a top or tail region of even greater flexibility.

The improved stringer elements of the invention include at least one stringer element in each system, but may include the use of a plurality of stringer elements; for example, two, three, four, or more of the same or selected length, as required, to obtain a bodyboard or other flotation board device of selected performance properties. For example, the bodyboard may include multiple, elongated, spaced-apart, generally parallel stringer elements in the bodyboard. The stringer elements may vary in diameter, shape, and length as used.

The bodyboard may be composed of any flotation-type foam material to include, but not limited to, substantially semirigid, substantially closed cell (or open cell when sealed) polymeric foam material, such as olefin polymers of polyethylene; polypropylene; and copolymers containing ethylene or propylene; urethane foams, and vinyl foam of vinyl polymers like polyvinyl chloride and other vinyl esters.

The bodyboard has a laminated top skin layer, may have appropriate decorative designs, as well as areas to prevent the movement of the rider's body in use, and a smooth, slick, laminate bottom skin layer.

In another embodiment of the invention, the variable, flexible stringer element may have a flexible section composed of a plurality of separate and different aligned flexible materials, or have the element with nonsequential sections of flexibility and stiffness, or have the flexible material in the tail of the bodyboard or nose of the bodyboard, or therebetween, to impart selected flexibility and stiffness, as described, along the length of the stringer elements. The stringer element may be a single element or a plurality of the same or different stringer elements. The stringer element, in a further embodiment, encompasses and is composed of a flat strip or strap-like material, woven or nonwoven, with selected portions stiffened by a thermoset resin and other portions flexible with a thermoplastic polymer. Typical impregnating thermoset resins would include: cured, unsaturated polyester resins; epoxy resins; and urethane resins, while thermoplastic polymers would include: polyolefins; urethanes; vinyl chloride polymers; and vinyl esters like polyvinyl acetate.

The invention shall be described for the purposes of illustration only in connection with certain illustrated embodiments; however, it is recognized that various modifications, additions, improvements, and changes may be made by persons skilled in the art without departing from spirit and scope of the invention as disclosed and claimed.

DESCRIPTION OF THE EMBODIMENTS

Figure 1:
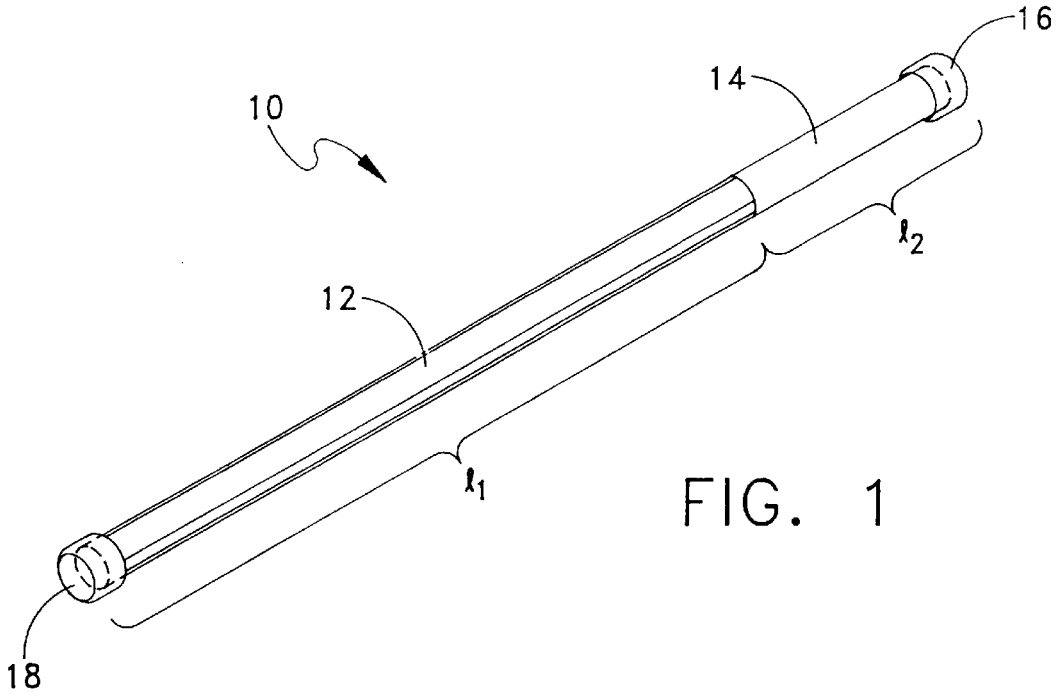
FIG. 1 is a perspective view of a stringer element of the invention.

FIG. 1 shows the stringer element rod 10 of the invention composed of a solid, 1 inch diameter rod composed of a first portion $l_1$ of about 28 to 32 inches in length of a thermoset resin impregnated glass fiber or graphite fiber material 12, with a second portion $l_2$ of about 6 to 12 inches in length of a solid polyethylene rod material 14. The rod 10 includes polyethylene end caps 16 and 18 snapped on the rod ends.

Figure 2:
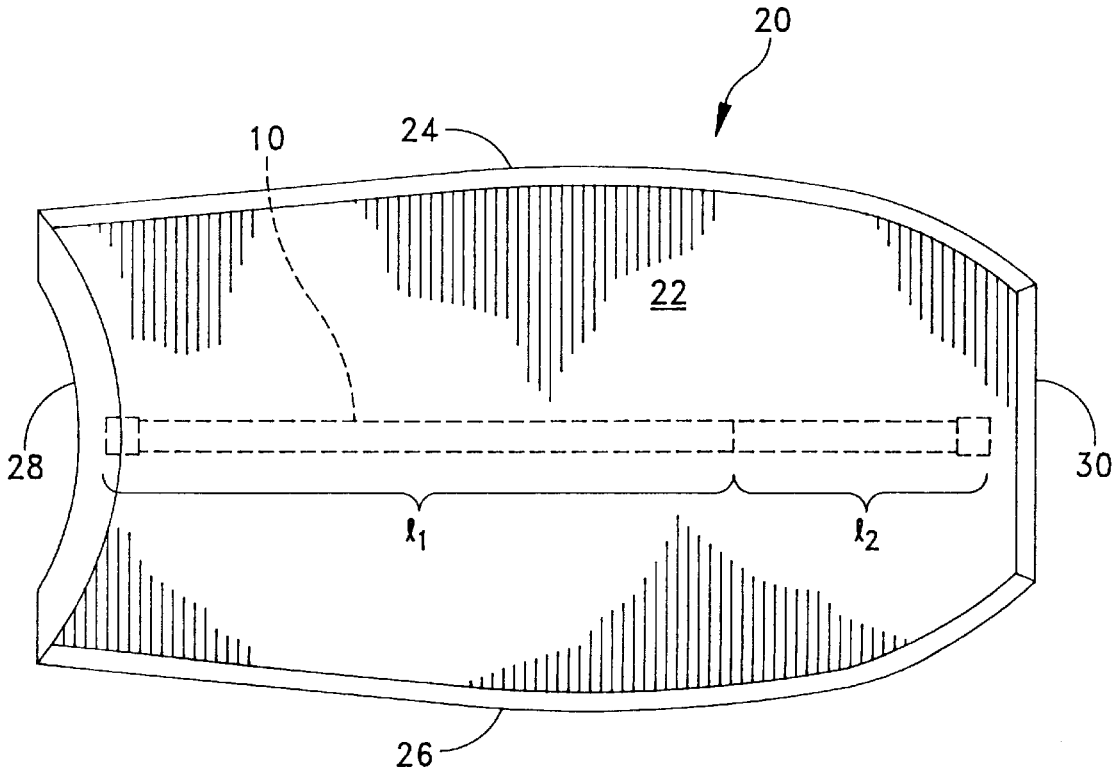
FIG. 2 is a top plan view of a bodyboard of the invention with the stringer element of FIG. 1 illustrated in dotted lines.
Figure 3:
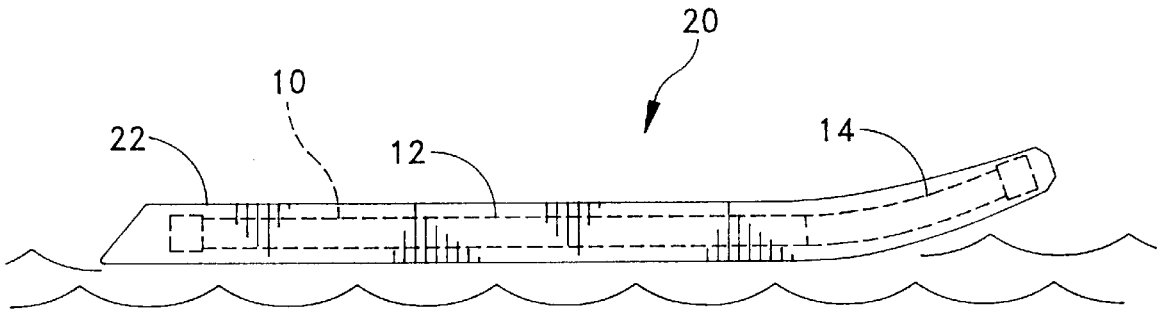
FIG. 3 is a side plan view of the bodyboard of FIG. 2 with the nose in a flexed position.

FIGS. 2 and 3 show a bodyboard 20 composed of a polyethylene foam core material and having a top skin layer 22, inclined side edges 24 and 26, a contoured tapered tail end 28, and a first nose chine 30. The bodyboard 20 has a centrally dispersed stringer rod element 10 within the foam core material, with the flexible portion 14 extending into the front nose area of the bodyboard 20. FIG. 3 illustrates the upward flex of the bodyboard 20 in use with the stringer rod element 10.

Figure 4:
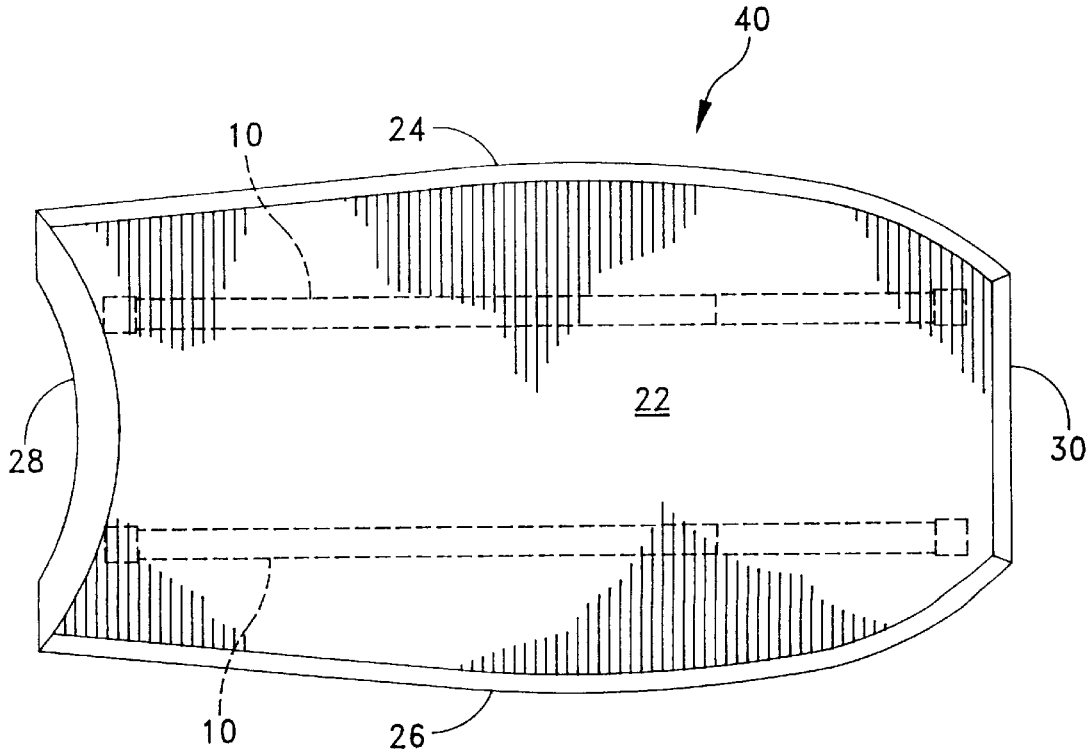
FIG. 4 is a top plan view of another embodiment of the bodyboard with a pair of stringer elements of FIG. 1.

FIG. 4 is a top plan view of a bodyboard 40 with a pair of spaced-apart parallel stringer rod elements 10 secured in the foam core material.

The bodyboard with the variable flexible stringer system of the invention, as described and illustrated, provides a bodyboard of enhanced durability and superior performance.

What is claimed is:

1. A variable flexible bodyboard which comprises:

a) a lightweight, generally elongated, foam core material having a top skin layer and a bottom skin layer, with a front nose end and a rear tail end; and b) an elongated stringer element having a one end and an other end, and generally longitudinally arranged within the foam core material and extending substantially from the tail end toward the front end; the stringer element varying in flexibility along the length from the one end to the other end, a substantial first length portion of the stringer extending at the one end from the tail end of the foam core material toward the nose end and adapted to increase the stiffness of the foam core material; and a second length portion toward the nose end of the foam core material, having greater flexibility than the first portion, and adapted to increase flexibility of the nose end of the bodyboard by a rider; and wherein the first length portion comprises a resin-impregnated fiber material, and the second length material comprises a polymeric olefin material.

2. The bodyboard of claim 1 wherein the stringer element comprises a rod element generally centrally positioned in the bodyboard.

3. The bodyboard of claim 1 wherein the second length portion comprises a material of the same or similar flexibility characteristic as the foam core material.

4. The bodyboard of claim 1 wherein the foam core material comprises a polyethylene foam material, and the material of the second length portion comprises polyethylene.

5. The bodyboard of claim 1 wherein the stringer element comprises at least a pair of rod elements spaced-apart and generally parallel in the bodyboard.

6. The bodyboard of claim 1 wherein the stringer element comprises a first length material of a glass fiber resin or graphite material, and the second length material comprises a polyethylene material.

7. The bodyboard of claim 1 wherein the stringer element include an end cap on the one end and the other end.

8. The bodyboard of claim 1 wherein the stringer element has a second length portion of about 6 to 12 inches.

9. The bodyboard of claim 1 wherein the stringer element comprises a solid cylindrical rod.

10. The bodyboard of claim 1 wherein the second length portion comprises about 20 to 50 percent in length of the stringer element.

11. The bodyboard of claim 1 wherein the first length portion and second length portion are different materials.

12. A stringer element adapted for insertion and use in the foam core material of a bodyboard, which stringer element comprises an elongated rod element having a one end and an other end and a selected length and composed of a first length portion which comprises a majority of the length of the rod element and comprises a fiber-resin material to impart selected stiffness to a bodyboard; and a second length portion which comprises, at the one end of the rod element, a polymeric material to support flexibility to a nose section of the bodyboard, which material has greater flexibility than the first length portion.

13. The stringer element of claim 12 wherein the polymeric material comprises polyethylene.

14. The stringer element of claim 12 wherein the fiber-resin material comprises a glass fiber or graphite resin impregnated material.

15. The stringer element of claim 12 which includes end caps on the one and other end.

16. A variable flexible bodyboard which comprises:

a) a lightweight, generally elongated, foam core material having a top skin layer and a bottom skin layer with a front nose end and a rear tail end;

b) an elongated stringer element having a one end and an other end, and composed of at least one stiffener material, of a defined length, to impart stiffness to the bodyboard, and at least one flexible material, of a defined length, to impart flexibility to the bodyboard, the stiffener material and flexible material composed of different materials, the stringer element positioned and secured within the foam core material of the bodyboard.

17. The bodyboard of claim 16 which includes a stringer element with the flexible material at the one or other end and the stiffener material between the one and other ends.

18. The bodyboard of claim 16 wherein the stringer element includes a plurality of flexible material lengths and a plurality of stiffener material lengths.

19. The bodyboard of claim 16 which includes a plurality of elongated stringer elements, spaced-apart and generally parallelly arranged in the foam core material.

20. The bodyboard of claim 16 wherein the stringer element comprises a solid olefin polymer at the one or other end of the stringer element, and the foam core material comprises a foam polyolefin core material.

21. The bodyboard of claim 16 wherein the stringer element has a glass or graphite fiber resin stiffener material and a polyethylene flexible material.

22. The bodyboard of claim 16 wherein the flexible material has a length of about 20 to 50 percent of the length of the stringer element.

23. The bodyboard of claim 16 wherein the stringer element has substantially uniform dimensions along the length of the stringer element.

24. The bodyboard of claim 16 wherein the stringer element comprises a solid cylindrical rod composed of a flexible polymeric material and fiber resin stiffener material.

* * * * *